US006199339B1

(12) United States Patent
Mudry et al.

(10) Patent No.: US 6,199,339 B1
(45) Date of Patent: Mar. 13, 2001

(54) MODULAR CONSTRUCTION SYSTEMS

(75) Inventors: Thomas Mudry, Gosula; Arthur J. Smith; L. Cleveland Fuessenich, both of Litchfield, all of CT (US)

(73) Assignee: Litchfield Gardening Systems, LLC, Litchfield, CT (US)

( * ) Notice: Subject to any disclaimer, the term of this patent is extended or adjusted under 35 U.S.C. 154(b) by 0 days.

(21) Appl. No.: 08/858,163

(22) Filed: Apr. 30, 1997

(51) Int. Cl.[7] ..... E04C 3/00

(52) U.S. Cl. ..... 52/574; 52/284; 52/589.1; 52/591.1; 52/590.1; 52/604

(58) Field of Search ..... 52/574, 284, 592.1, 52/589.1, 439, 590.2, 590.3; 446/124, 122; 403/331, 4, 381, 174, 217, 403, 231

(56) References Cited

U.S. PATENT DOCUMENTS

| | | | | |
|---|---|---|---|---|
| 1,570,233 | * | 1/1926 | Feigenbaum | 52/284 |
| 1,780,086 | * | 10/1930 | Linn | 52/284 |
| 1,898,297 | | 2/1933 | Fox . | |
| 1,984,393 | * | 12/1934 | Brown | 52/284 |
| 2,031,194 | * | 2/1936 | Thompson | 446/127 |
| 2,619,574 | * | 11/1952 | Lambert et al. | 219/105 |
| 3,415,007 | | 12/1968 | August-Wilhelm Howe . | |
| 3,660,928 | * | 5/1972 | Michel | 446/124 |
| 3,722,704 | * | 3/1973 | Piretti | 211/183 |
| 3,757,445 | * | 9/1973 | Stilwell | 40/788 |
| 3,800,494 | | 4/1974 | Hall et al. . | |
| 3,992,834 | * | 11/1976 | Valenzano | 52/220.2 |
| 4,099,887 | * | 7/1978 | Mackenroth | 403/4 |
| 4,367,615 | * | 1/1983 | Feldman | 52/591.1 |
| 4,414,267 | * | 11/1983 | Coran et al. | 428/361 |
| 4,717,742 | * | 1/1988 | Beshay | 523/203 |
| 5,076,534 | * | 12/1991 | Adam | 248/678 |
| 5,194,461 | * | 3/1993 | Bergquist et al. | 524/13 |
| 5,728,824 | * | 3/1998 | Narayan et al. | 536/107 |
| 5,930,958 | * | 8/1999 | Stanley | 52/284 |

* cited by examiner

*Primary Examiner*—Christopher T. Kent
*Assistant Examiner*—Jennifer I. Thissell
(74) *Attorney, Agent, or Firm*—Milde, Hoffberg & Macklin, LLP

(57) ABSTRACT

A durable, modular, adaptive containment system, which has a composite composition comprised of wood fibers embedded in a polymeric matrix, the system being suitable for holding soil and plants, and which is comprised of rails, preferably of rectangular cross-section, each of said rails being joined by means of a T-shaped tenon along one of its ends and a complementary T-shaped channel on the side of the rail near its other end, or which is comprised of a connector having T-shaped channels so that when four rails, each of which has a T-shaped tenon on each end, pairs of which are of equal length, are joined by inserting the T-shaped tenons of each rail into a complementary T-shaped channel on a connector, a rectangular containment system is formed.

30 Claims, No Drawings

MODULAR CONSTRUCTION SYSTEMS

BACKGROUND OF THE INVENTION

The present invention relates to a novel construction system, which is particularly suitable to make a durable, modular, adaptive landscape containment system.

U.S. Pat. No. 1,898,297 describes a child's building block set made of unspecified material. The block set consists of a plurality of four-sided corner blocks, each side having a dove-tail vertical groove, and a plurality of side members, each provided at each end with a dove-tail projection to fit said grooves, and combined filler and locking blocks to fit and fill the grooves in said corner blocks.

U.S. Pat. No. 3,800,494 describes a connecting structure for timbers, suitable for building log cabins, in which the mating ends of adjacent logs are provided with matching half dovetail cores which are perpendicularly insertable in overlapping relation into transverse notches formed around a core in an intersecting log. The half dovetail cores when inserted together form a core the length of which is appreciably less than the overall width of the timber so that the vertical edges of the timbers on opposite sides of the notches in the intersecting core are tightly drawn against the adjacent opposite sides or faces of the intersecting timber.

SUMMARY OF THE INVENTION

It is an object of the present invention to provide a modular and adaptive containment system for containing soil and plants.

It is an object of the present invention to provide such a system that is durable and capable of surviving the elements for decades.

It is another object of the present invention to provide such a system that is resistant to rot and insect damage without the need to De impregnated with environmentally harmful compounds.

It is another object of the present invention to provide such a system from which environmentally harmful compounds do not leach.

It is still another object of the present invention to provide such a system that does not require one to wear a dust mask when cutting the components of the system as would be required to cut wood impregnated with environmentally harmful compounds.

Yet another object of this invention is to provide such a system that is dimensionally stable and not subject to unacceptable warping, swelling, or freezing and splitting when in contact with water.

It is a further object of this invention to provide such a system that is environmentally friendly to manufacture, using recycled materials, e.g., scrap wood and recycled plastic.

It is a still further object of this invention to provide an improved process for the manufacture of the systems of this invention.

These objects, as well as further objects which will become apparent from the discussion that follows, are achieved, in accordance with the present invention, by a durable, modular, adaptive containment system, which has a composite composition comprised of wood fibers embedded in a polymeric matrix, the system being suitable for holding soil and plants, and which is comprised of rails, preferably of rectangular cross-section, each of said rails being joined by means of a T-shaped tenon along one of its ends and a complementary T-shaped channel on the side of the rail near its other end, or which is comprised of a connector having T-shaped channels so that when four rails, each of which has a T-shaped tenon on each end, pairs of which are of equal length, are joined by inserting the T-shaped tenons of each rail into a complementary T-shaped channel on one of four connectors, a rectangular containment system is formed.

PREFERRED EMBODIMENTS OF THE INVENTION

The invention is a system which is capable of creating a four-sided box needing no external fasteners, tools, or expertise to assemble. Applications include raised-bed boxes for gardens, sandboxes for children, window boxes, and other items using the product's system for joining components.

The material used is a polymer-wood composite with appearance and dimensions similar to pressure-treated lumber. One of its unique features is that the strength of the composite material allows construction of the box with joints that would not be durable if made of conventional wood lumber. It is this characteristic which sets the product apart from others which employ conventional joining methods.

One preferred embodiment of the invention comprises a durable, modular, adaptive containment system, which is comprised of rails, each of said rails having a composite composition, which comprises wood fibers embedded in a polymeric matrix, and having a T-shaped tenon along one of its ends and a complementary T-shaped channel on the side of the rail near its other end, so that when four of the said rails, pairs of which are of equal length, are joined by inserting the T-shaped tenons of each rail into the complementary channel on another rail, a rectangular containment system is formed.

Preferred is a single element version of the invention. In this version, a rail has a T-shaped tenon on one end and located on its side near its other end is a T-shaped channel, into which a T-shaped tenon from a second rail may be slid. In like manner, the T-shaped tenon of a third rail may be slid into the T-shaped channel of the first rail. The T-shaped tenon of a fourth rail (not shown) may be slid into the T-shaped channel of the third rail while the T-shaped tenon of the second rail is simultaneouslv slid into the T-shaped channel of the fourth rail. The result is a rectangular containment system when four rails, at least pairs of which are of equal length, are joined.

An alternative version is also possible, but is generally not preferred because the alternative version is a two-element design. Consequently, it would be necessary to stock two kinds of components in inventory. In this design, one rail would have two T-shaped tenons, one on each end; and another rail would have two T-shaped channels, both on the same side of the rail, one near and parallel to each end.

A more versatile preferred embodiment of the invention comprises a durable, modular, adaptive containment system, which is comprised of:

(a) at least three rails, having a T-shaped tenon along each of their ends, (b) connectors having at least two T-shaped channels on their sides which mate with said T-shaped tenons, so that they are capable of joining at least two of the said rails and that when the T-shaped tenons of each rail are inserted into the complementary channel on a connector, a containment system is formed, the relative angular placement of the channels on the connector being such that they are capable of forming a polygon with the number of rails being used, and wherein the rails and connectors are comprised of a composite composition, which comprises wood fibers embedded in a polymeric matrix.

A second, more versatile embodiment of the invention has T-shaped tenons on either end of a rail A connector for a second embodiment of the invention may have 2, 3 or 4 T-shaped channels, into which the T-shaped tenons of rails may be slid. Centrally located in the connector is a central longitudinal hole, through which a pipe, such as a PVC pipe, or a rod, such as a rebar, may be inserted to align and to join together several levels of the systems of the invention or to anchor one or more of the levels of the systems of the invention to the ground when the system is used for landscaping purposes. Instead of a hole at that location, there could be a projection, which would fit into a complementary depression in the other end of a similar connector in order to align several levels of the containment system, stacked one on top of another.

Thus a connector may be connected through its channel to the T-shaped tenon on one end of a rail for the second embodiment of the invention.

Either kind of rails may have longitudinal tongues running the length of one edge and longitudinal grooves running the length of the other edge. The tongue of one level may be inserted into the groove of another level of a containment systems in order to align and to join them together. The tongue or groove may be used for other purposes as well. For example, one can place a horizontal piece of plywood or a piece of the wood-polymer composite having the complementary groove or tongue across the top of a containment system of the invention and thereby create a seat or table. To create a cold frame, one would put a piece of glass or plastic in a frame having the complementary groove or tongue around its perimeter, across the top of a containment system of the invention. To avoid the use of pesticides, one can grow vegetables in a screened in growing bed made by putting a piece of screen in a frame having the complementary groove or tongue around its perimeter, across the top of a containment system of the invention.

In the more versatile preferred embodiment, the product is comprised of two basic components of various dimensions:

1) Horizontal Rails with T-shaped tenons on their ends, and
2) Vertical Connectors with T-channels into which the T-shaped tenons on the ends of the horizontal rails are fitted.

Therefore, the invention has the following design advantages:

A) Modular construction—because of standardized joints, like components of various dimensions can be interchanged with each other,
B) Flexibility—the product can be adapted in nearly limitless ways using basic components,
C) Expandability—the configuration can be modified without discarding original parts, and
D) Ease of assembly and disassembly—the product can be put together and taken apart by practically anyone with no tools or other materials needed.

Consequently, the invention addresses the need for a simple, inexpensive product which can be used by gardeners to form raised beds without tools or expertise.

The invention employs a wood-polymer composite for its components. Sides rails of the raised beds are preferably constructed from 2"×6" (1½"×5½" actual dimensions) material in one, two, four, and eight foot lengths. Connectors (corners and extenders) are preferably formed from 4"×4" posts in lengths of 5½" and multiples thereof.

Joints consist of T-shaped channels in the connectors which receive and lock on to T-shaped tenons at the ends of the raised-bed side rails. Connectors may; have two, three, or four channels allowing for a total of five joint variations.

With this invention, raised beds can be constructed in a large variety of dimensions from one foot square to virtually unlimited lengths and widths. The heights of beds can be raised in 5½" increments by stacking sides one on top of the other and joining them with, e.g., taller connectors.

Illustrative of the polymers that may be present in the polymeric matrix for the wood-polymer composite are the thermoplastic resins, such as the polyolefins, e.g., polyethylene and polypropylene; the polyesters such as polyethylene terephthalate; the polyamides such as Nylon 6, Nylon 66 and Nylon 7; polyvinyl chloride; and the like. Mixtures of one or more polymers may be used as well. It is not necessary to use more expensive virgin polymers for the matrix. Instead cheaper and plentiful recycled plastics may be used. Thermosetting resins, such as polyepoxides and the like may be also be used.

The polymeric matrix should be present in the composite in an amount sufficient to bind the wood fibers together and yet not so much of an amount that the wood fibers do not impart a substantial reinforcing effect to the composite. The polymeric matrix may be present in an amount of at least about 25 weight percent of the composite. The polymeric matrix is preferably present in an amount of from at least about 30 to about 50 weight percent of the composite.

The wood fiber component of the composite may be made from any source of scrap lumber, e.g., from lumber mills, demolition sites or manufacturing facilities. Sawdust from these sources may be used as well.

Two sources for suitable wood-polymer composite material for the systems of the invention are TREX® wood-polymer lumber available from Mobil Chemical Company and DURAWOOD® EX Engineered Wood Profiles available from Eaglebrook Products, Inc. The TREX® wood-polymer lumber absorbs 1.7% water. The DURAWOOD® EX Engineered Wood only absorbs 0.2% water. In contrast, ponderosa pine absorbs 17.2% water.

Prototypes of the systems of the invention were made by using conventional woodworking power tools, particularly a router to form the T-shaped channels in the connectors and the T-shaped tenons at the ends of the raised-bed side rails.

A preferred method for manufacturing the systems of the invention comprises the use of thermoplastic forming machinery, particularly an extruder, to extrude the molten composite mass in order to form the T-shaped channels in the connectors and the longitudinal tongues running the length of one edge and longitudinal grooves running the length of the other edge of the side rails. This is a convenient and economical way to proceed because the composite is extruded to form the parts used in the systems of the invention. In molding, there is no separate shaping operation required, and there is no dust hazard from concomitant with the use of woodworking equipment. In addition, there is no waste to contend with, either by discarding or adding as regrind to the composite mass to be extruded. Thermoplastic forming machinery may also be used to form the T-shaped tenons at the ends of the raised-bed side rails. To form the T-shaped tenons the shape of the tenon is impressed upon the end of the rail by means of a heated T-shaped female mold. The mold is bisected vertically through the "T". To form the tenon, the end of the rail, preferably preheated, is inserted between the two halves of the heated mold. The two halves of the mold are then brought together under pressure to form the T-shaped tenon. Excess composite is squeezed out of an orifice in the mold. The molded tenons and channels fit together and come apart mere easily because the molding produces smoother surfaces of the joint between the tenons and channels than is produced by use of woodworking equipment. In addition, the molded surfaces do not absorb as much water as machined surfaces.

The foregoing specification has described a novel modular construction system which fulfills all the objects and advantages sought therefor. Many changes, modifications, variations and other uses and applications of the subject invention will, however, become apparent to those skilled in the art after considering this specification, which discloses the preferred embodiments thereof. All such changes, modifications, variations and other uses and applications which do not depart from the spirit and scope of the invention are deemed to be covered by the invention, which is to be limited only by the claims which follow.

What is claimed is:

1. A durable, modular, adaptive containment system, which is comprised of rails, said rails having a composite composition, comprised of wood fibers embedded in a polymeric matrix, and having a T-shaped tenon along one of its ends and a complementary T-shaped channel on the side of the rail near its other end, so that when four of the said rails, pairs of which are of equal length, are joined by inserting the T-shaped tenons of each rail into the complementary T-channel on another rail, a rectangular containment system is formed.

2. The containment system claimed in claim 1, wherein the rails are of generally rectangular cross-section.

3. The containment system claimed in claim 1, wherein the T-shaped tenons are molded on the rails.

4. The containment system claimed in claim 1, wherein the system has a means for aligning more than one level of the systems stacked one on top of another.

5. The containment system claimed in claim 4, wherein the means for aligning is a tongue on one longitudinal edge of the rail and a groove along the other longitudinal edge.

6. The containment system claimed in claim 5, wherein the tongue on one longitudinal edge of the rail and the groove along the other longitudinal edge are molded.

7. The containment system claimed in claim 1, wherein the polymeric matrix for the wood-polymer composite is a thermoplastic resin or a thermosetting resin.

8. The containment system of claim 1, wherein the polymeric matrix is a polyolefin, a polyester or a polyamide.

9. The containment system of claim 1, wherein the polymeric matrix is polyethylene, polypropylene, polyethylene terephthalate, Nylon 6, Nylon 66 or Nylon 7, polyvinyl chloride, or mixtures thereof.

10. The containment system claimed in claim 1, wherein the polymeric matrix is derived from recycled plastic.

11. The containment system of claim 1, wherein the polymeric matrix is present in the composite in an amount sufficient to bind the wood fibers together and yet not so much of an amount that the wood fibers do not impart a substantial reinforcing effect to the composite.

12. The containment system of claim 1, wherein the polymeric matrix is present in an amount of at least about 25 weight percent of the composite.

13. The containment system of claim 1, wherein the polymeric matrix is present in an amount of at least about 30 to about 50 weight percent of the composite.

14. A durable, modular, adaptive containment system, which is comprised of:

(a) at least three rails, having a T-shaped tenon along each of their ends, and (b) connectors having at least two T-shaped channels on their sides which mate with said T-shaped tenons, so that they are capable of joining at least two of the said rails and that when the T-shaped tenons of each rail are inserted into the mating channel on a connector, a containment system is formed, the relative angular placement of the channels on the connector being such that they are capable of forming a polygon with the number of rails being used, and wherein the rails and connectors are comprised of a composite composition comprised of wood fibers embedded in a polymeric matrix.

15. The containment system claimed in claim 14, wherein the channels are molded in the connectors.

16. The containment system claimed in claim 14, wherein the T-shaped tenons are molded on the rails.

17. The containment system claimed in claim 14, wherein the rails are of generally rectangular cross-section.

18. The containment system claimed in claim 14, wherein four rails are used.

19. The containment system claimed in claim 14, wherein the polymeric matrix for the wood-polymer composite is a thermoplastic resin or a thermosetting resin.

20. The containment system of claim 14, wherein the polymeric matrix is a polyolefin, a polyester or a polyamide.

21. The containment system of claim 14, wherein the polymeric matrix is polyethylene, polypropylene, polyethylene terephthalate, Nylon 6, Nylon 66 or Nylon 7, polyvinyl chloride, or mixtures thereof.

22. The containment system claimed in claim 14, wherein the polymeric matrix is derived from recycled plastic.

23. The containment system of claim 14, wherein the polymeric matrix is present in the composite in an amount sufficient to bind the wood fibers together and yet not so much of an amount that the wood fibers do not impart a substantial reinforcing effect to the composite.

24. The containment system of claim 14, wherein the polymeric matrix is present in an amount of at least about 25 weight percent of the composite.

25. The containment system of claim 14, wherein the polymeric matrix is present in an amount of at least about 30 to about 50 weight percent of the composite.

26. The containment system of claim 14, wherein the system has a means for aligning more than one level of the systems stacked one on top of another.

27. The containment system of claim 26, wherein the means for aligning is a tongue on one longitudinal edge of the rail and a groove on the other longitudinal edge of the rail.

28. The containment system claimed in claim 27, wherein the tongue on one longitudinal edge of the rail and the groove along the other longitudinal edge are molded.

29. The containment system of claim 26, wherein the means for aligning are longitudinal holes drilled in the connectors and capable of accepting a pipe or a rod of a length sufficient to unite the number of levels stacked one on another.

30. The containment system of claim 26, wherein the means for aligning are projections on one end of the connectors and corresponding indentations on the other end of the connectors capable of aligning a number of levels stacked one on another.

* * * * *